US005359392A

United States Patent [19]

Muto

[11] Patent Number: 5,359,392

[45] Date of Patent: Oct. 25, 1994

[54] ELECTRO-PHOTOGRAPHIC DEVICE

[75] Inventor: Kiyoshi Muto, Yokkaichi, Japan

[73] Assignee: Brother Kogyo Kabushiki Kaisha, Nagoya, Japan

[21] Appl. No.: 994,326

[22] Filed: Dec. 21, 1992

[30] Foreign Application Priority Data

May 22, 1992 [JP] Japan ..... 4-130587

[51] Int. Cl.[5] ..... G03G 21/00

[52] U.S. Cl. ..... 355/206; 355/282; 219/216

[58] Field of Search ..... 355/206, 203, 285, 282, 355/289, 290; 219/216

[56] References Cited

U.S. PATENT DOCUMENTS

| | | | |
|---|---|---|---|
| 3,737,159 | 6/1973 | Washio et al. | 355/206 |
| 4,260,904 | 4/1981 | Horie et al. | 355/206 |
| 4,373,802 | 2/1983 | Yuge et al. | 355/206 |
| 4,873,549 | 10/1989 | Tada et al. | 355/206 |

FOREIGN PATENT DOCUMENTS 267768 11/1986 Japan .

*Primary Examiner*—Benjamin R. Fuller
*Assistant Examiner*—J. E. Barlow, Jr.
*Attorney, Agent, or Firm*—Oliff & Berridge

[57] ABSTRACT

In an electro-photographic device for printing photographic images by fixing heated toner on printing paper. The electro-photographic device has a cover which is opened by an operator during maintenance and error recovery operations. Since the device has a paper sending unit provided on both the main body and the cover of the device, the paper sending unit has to be driven to recover synchronization after the operation is completed. On the other hand, the device cuts off power to the fixation unit for safety reasons during the operation which causes the fixation unit to cool. The present device is characterized in that the device starts the recovery procedure after the temperature of the fixation unit reaches an optimal point above the melting point of the toner so that the fixation unit is not damaged by solid toner.

18 Claims, 5 Drawing Sheets

ELECTRO-PHOTOGRAPHIC DEVICE

BACKGROUND OF THE INVENTION

1. Field of the Invention

The present invention relates to an electro-photographic device, and more particularly to an electro-photographic device which is capable of controlling a paper feeding unit according to the result of a paper detecting examination.

2. Description of Related Art

In conventional electro-photographic devices, a toner tank for storing toner and a cartridge which houses a photo-sensitized drum for forming toner images are detachably provided on an upper cover, and the upper cover is attached to the main body of the device so that the upper cover shuts and opens. The photo-sensitized drum is connected to a paper feeding unit with a paper sending roller via a gear provided on the cartridge, and the paper sending roller rotates in synchronization with the photosensitized drum. Operators open the upper cover when they exchange a cartridge or remove printing paper from the electro-photographic device under a "paper jam" state, in which the device is unable to feed the printing paper.

The paper feeding unit is driven for a fixed period of time to recover synchronization in the gear connections when the upper cover is shut after a paper removal operation or a cartridge exchange operation.

In an electro-photographic device of the above description, a pair of fixation rollers, provided in the electro-photographic device for fixing toner images, cools during the paper removal operation or cartridge exchange operation. If the upper cover is shut with printing paper remaining in the device after the paper removal operation or the cartridge exchange operation, there is a possibility that the paper remaining in the device will be fed by the paper feeding unit and sent to the fixation rollers.

The surface of the fixation roller pair has a silicon film coating for preventing melting toner from adhering to the surface. When printing paper is sent to cold fixation rollers, the film on the surface is damaged by the toner, because the toner does not melt between the cold rollers. Consequently, the toner adheres to the damaged surface of the fixation rollers after the electrophotographic device resumes normal operation with the surface of the rollers set at the prescribed fixing temperature, resulting in defective printed images.

SUMMARY OF THE INVENTION

The present invention was developed to solve the above and other problems, and it is therefore an object of the present invention to provide an electro-photographic device which creates printed images free from defects. To accomplish this object, the device adds a function to decide whether or not to send the printing paper to the fixation rollers based on the results of a paper sensing examination. In other words, the electro-photographic device drives the paper feeding unit when there is no printing paper left in the device, and does not drive the paper feeding unit when there is printing paper remaining in the device.

To achieve the above and other objects, the electro-photographic device of the present invention has a paper feeding means for feeding printing paper, a cover detection means for examining the status of the cover provided on the main body, a paper detection means for detecting the presence of paper in the device, and a control means for deciding whether or not to feed the paper according to the result of paper detecting examination.

In an electro-photographic device of the above construction, the control means drives the paper feeding means when the cover detection means finds that the cover is closed and the paper detection means finds that there is no paper in the device. On the other hand, the control means prohibits driving of the paper feeding means when the cover detection means finds that the cover is closed and the paper detection means finds that there is printing paper remaining in the electro-photographic device.

As is apparent from the above description, the electro-photographic device of the present invention prohibits operation of the feeding unit when the fixation rollers are cool and paper remains in the device, eliminating the incidence of damage to the photo-sensitized drum.

BRIEF DESCRIPTION OF THE DRAWINGS

A preferred embodiment of the present invention will be described in detail with reference to the following figures.

DETAILED DESCRIPTION OF PREFERRED EMBODIMENTS

Hereinafter, a preferred embodiment of the present invention is described with references to FIGS. 1–5.

Figure 1:
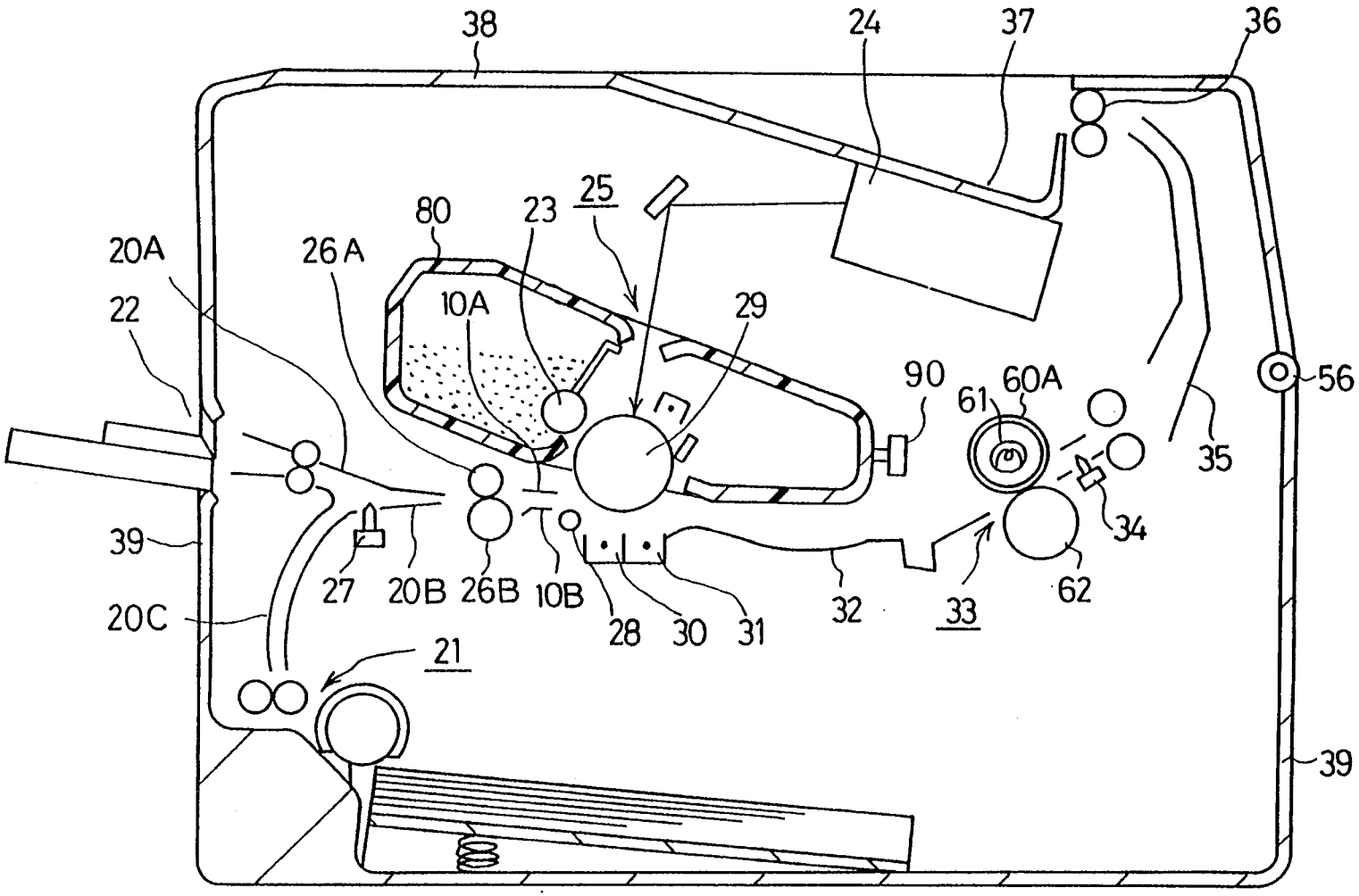
FIG. 1 is a cross-sectional view schematically depicting an electro-photographic device in a preferred embodiment of the present invention.

As shown in FIG. 1, the electro-photographic device has an automatic paper supply unit 21 provided in the lower portion of the electro-photographic device and a manual paper supply unit 22 provided on the left side of the device. Printing paper is sent from either of the paper supply units to an image formation unit 25 provided in the center of the electro-photographic device.

Between the paper feeding units 21 and 22 and the image formation unit 25 are guides 20A, 20B and 20C for guiding printing paper to the image formation unit 25. A paper sensor 27 is provided in the paper passage formed by the guides 20A and 20B, and a pair of resist rollers 26A and 26B are provided between the paper sensor 27 and the image formation unit 25.

The resist rollers 26A and 26B start rotation after a fixed time duration following a paper detection signal sent from the paper detection means.

Printing paper is properly positioned when it reaches the resist rollers. Resist rollers 26A and 26B begin rotation to send the paper in the right direction (as viewed in FIG. 1) when paper reaches the rollers. The paper is sent to the image formation unit as the resist rollers rotate.

Beyond the resist rollers 26A and 26B, a pair of guides 10A and 10B are provided in confrontation forming a paper passage. Farther beyond the guides 10A and 10B is a guide roller 28 provided in confrontation with the photosensitized drum 29. The guide roller 28 feeds the printing paper sent to the image formation unit 25 so that the paper closely contacts the photo-sensitized drum 29. As a result, the printing paper is sent from resist rollers 26A or 26B, guided through guides 10A and 10B to the guide roller 28, and fed to the image formation unit 25.

The image formation unit 25 has a photo-sensitized drum 29, exposure unit 24, a developing unit 23, a transfer unit 30 and an electrostatic eraser 31. The exposure unit 24 exposes the photo-sensitized drum 29 to generate an electro-static latent image on the drum 29. A toner image is formed on the photo-sensitized drum 29 by adhering toner to the electrostatic latent image by the developer unit 23. The transfer unit 30 transfers the toner image from the photo-sensitized drum 29 to the printing paper, and the electrostatic eraser 31 erases the electrostatic charge on the printing paper to release the printing paper from the photo-sensitized drum 29.

The photo-sensitized drum 29 and the developing unit 23 are provided in a cartridge 80 for storing toner. The cartridge 80 is detachably provided on a cover 38, 39. The upper cover 38 has a cartridge switch 90 for detecting the installation of the cartridge.

The printing paper carrying a toner image formed in the image formation unit 25 is guided on the surface of a feeding guide unit 32 and sent further to the fixation unit 33. The fixation unit 33 has a heat roller 60A with a heater 61 inside and a contact roller 62 contacting the heat roller 60A. The fixation unit 33 melts the toner and fixes the toner image onto the printing paper when the printing paper passes between the heat roller 60A and the contact roller 62. The surface of the heat roller 60A is preferably coated with a silicon film so that the melting toner does not adhere to the heat roller 60A. Other suitable films or coatings may also be used to prevent the melting toner from adhering to the heat roller 60A.

The printing paper on which the toner image is fixed is sent along the paper passage formed by a paper discharge guide 35 provided on the upper-left portion of the electro-photographic device to reach the paper discharge roller 36 and is discharged to the paper discharge tray 37.

Near the fixation unit 33 of said paper discharge unit is a paper jam sensor 34 provided for the detection of the paper status. When the paper jam sensor 34 fails to turn on after a fixed interval after the printing paper is sent by the pair of resist rollers 26a and 26b, or the paper jam sensor 34 fails to turn off after a fixed interval after it turns on, the microcomputer 40 (shown in FIG. 4) decides that the electrophotographic device is in a paper jam status. Consequently, the microcomputer 40 stops the main motor 70 to abort the print execution, and informs an operator of a paper jam status by beeping the buzzer 86 and/or displaying a message on the LCD (Liquid Crystal Display) 85.

In this embodiment, the resist rollers 26A and 26B, the guide roller 28 and the paper discharge roller 36 etc. constitute the feeding means of the present invention, and the paper sensor 27 and the paper jam sensor 34 constitute the paper detection means of the invention.

The cover switch is described with reference to FIG. 2A and FIG. 2B. The cover of the electrophotographic device consists of two pieces: an upper cover 38 and a lower cover 39. The upper cover 38 and the lower cover 39 are connected at a pivot shaft 56 on an end of each cover. Therefore, the upper cover 38 is movably supported about the pivot shaft 56. On another end of the upper cover 38 is a projection 51 jutting towards the lower cover 39.

On another end of the lower cover confronting the projection 51 is a cover switch 50. The cover switch 50 consists of an actuator 52 which is movably provided in the horizontal direction, a contact 53 and a terminal 54. The contact 53 and the terminal 54 are preferably leaf springs. The actuator 52 is connected to the contact 53, and the contact 53 is connected to the microcomputer 40 via a signal line 57. The signal line 57 is connected to a low voltage power supply unit 44 (shown in FIG. 4) via a pull-up resistance 55, and the terminal 54 is connected to ground.

Figure 2A:
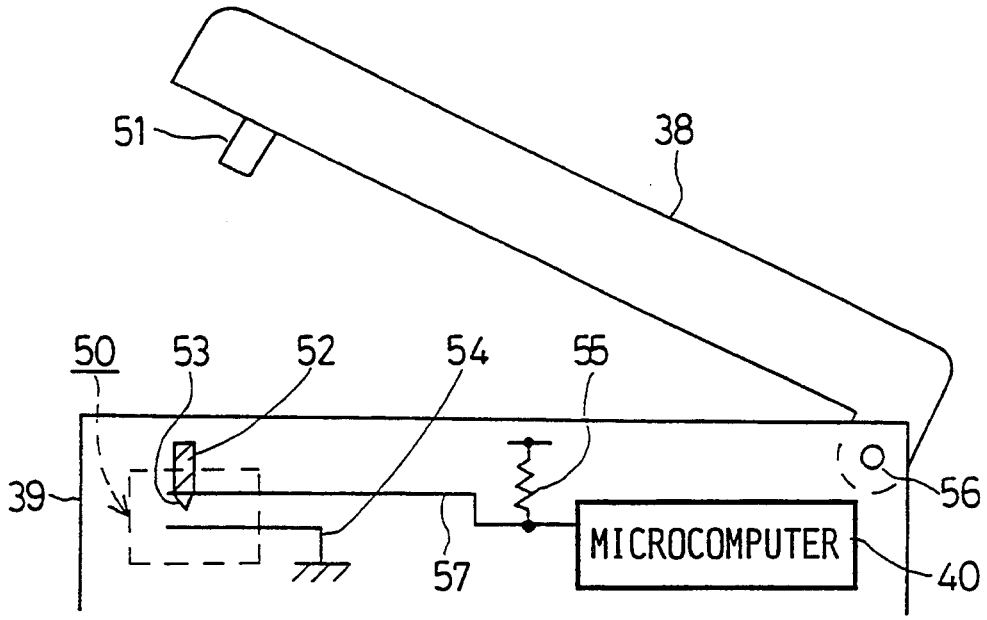
FIG. 2A is a schematic illustration showing the structure of a cover switch.

As shown in FIG. 2A, when the upper cover 38 is open, the contact 53 and the terminal 54 are separated across a fixed distance and a high-level signal from the pull-up resistance 55 is input to the microcomputer 40.

Figure 2B:
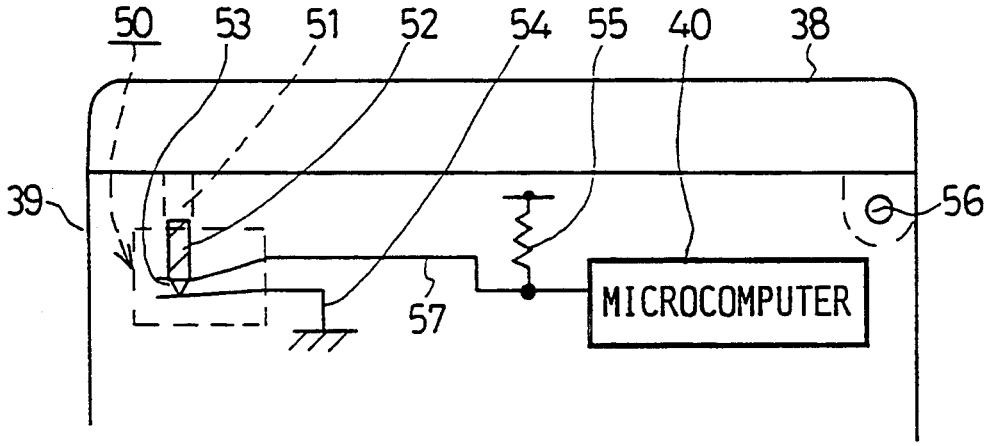
FIG. 2B is a schematic illustration showing the cover switch with the cover closed.

As shown in FIG. 2B, when the upper cover 38 is closed, the actuator 52 in the cover switch 50 is urged downward by the projection 51. The leaf spring of the contact 53 is bent from the urging force of the projection 51, and the contact 53 electrically connects with the terminal 54, allowing current to flow through the pull-up resistance 55 and lowering the level of signal input to the microcomputer 40 via signal line 57.

Figure 3:
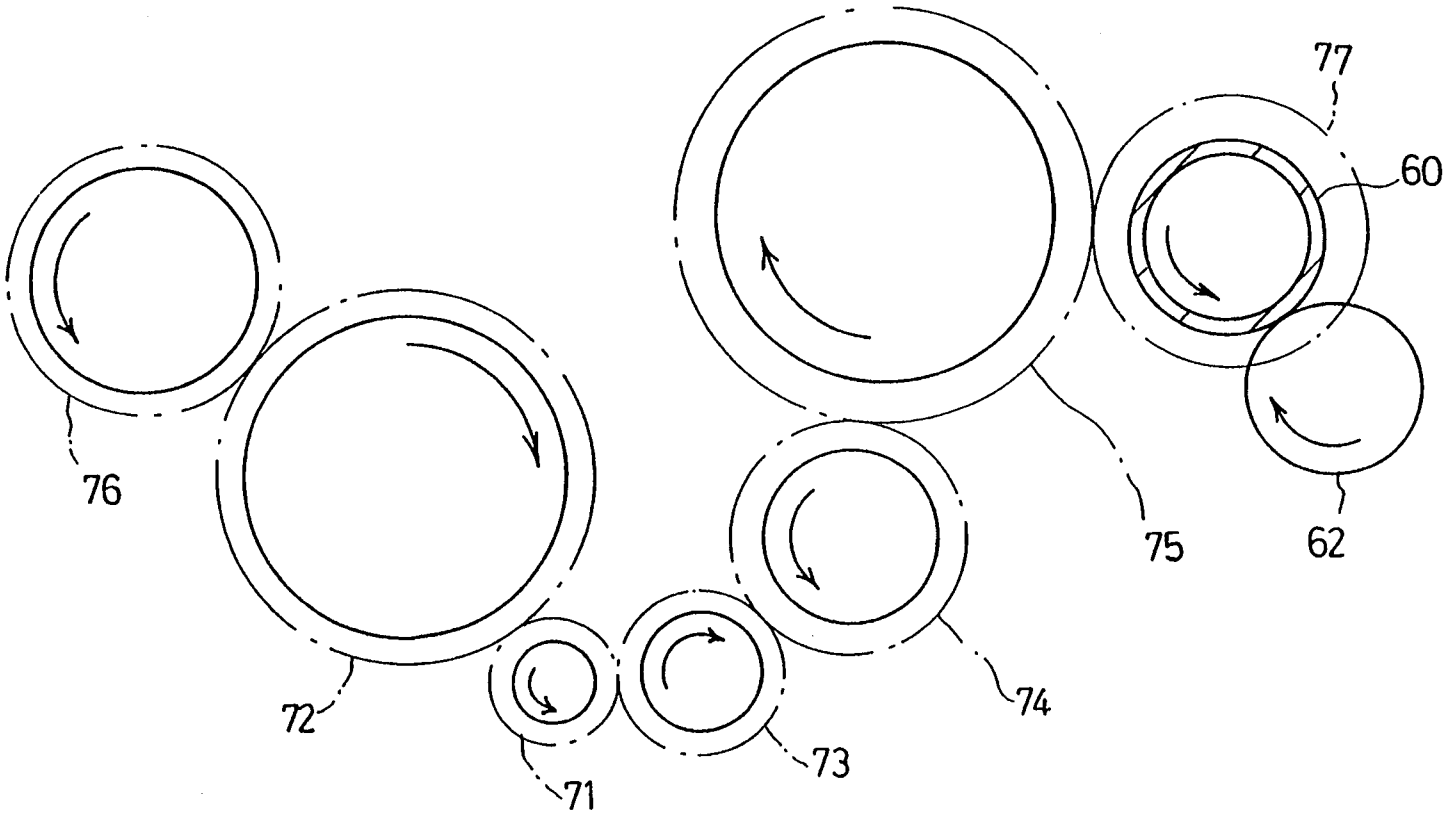
FIG. 3 schematically shows a driving mechanism of the electro-photographic device.

The driving mechanism of the electro-photographic device is described with reference to FIG. 3 and FIG. 4. A driving gear 71 is coaxially provided on the shaft of the main motor 70, and a signal sent via a motor driver 42 from the control device 40 (described later) drives the main motor 70 to rotate counterclockwise. Rotating motion of the driving gear is transmitted via the first transmission gear 72 to the roller gear 76 which is coaxially provided on the shaft of the photo-sensitized drum 29 to turn the photo-sensitized drum 29 counterclockwise. Now, the roller gear 76 on the shaft of photo-sensitized drum 29 draws apart from the first transmission gear 72 and loses connection with the gear. The roller gear 76 and the first transmission gear 72 recover connection when the upper cover 38 is closed.

Rotating motion of the driving gear 71 is transmitted via second transmission gear 73, third transmission gear 74 and fourth transmission gear 75 to drive the heat roller driving gear 77 and the heat roller 60A counterclockwise. The driving mechanism is designed so that the circumferential rotation speed is the same at the photosensitized drum 29 and the heat roller 60A, preventing the printing paper from slackening or straining.

On the other hand, main motor 70 is connected to resist rollers 26A and 26B via a solenoid clutch 47. Rotation of the main motor 70 is transmitted through the solenoid clutch 47 which connects and disconnects according to the signal given by the microcomputer 40. In addition, motion of the main motor 70 is transmitted through a transmission gear (not shown) to the guide roller 28, and still farther to the automatic paper supply unit 21 and the manual paper supply unit 22 through another transmission gear (not shown).

Figure 4:
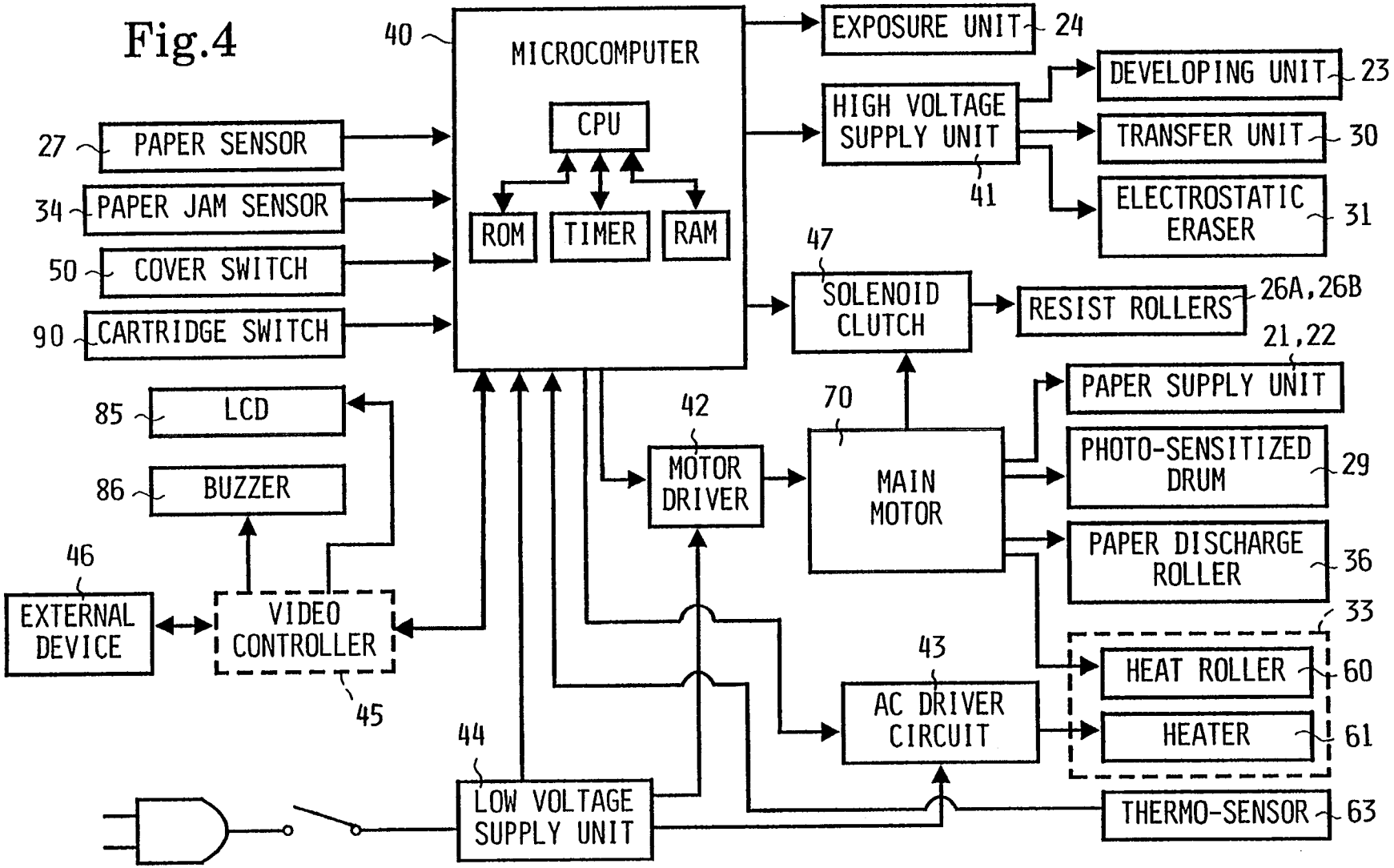
FIG. 4 schematically shows the control scheme of the electro-photographic device.

FIG. 4 shows the control unit 40 of the electro-photographic device. The control unit comprises the microcomputer 40. The microcomputer 40 has a CPU, ROM, RAM and a timer, and an external bus which interconnects the elements. The timer counts preset intervals.

The microcomputer 40 is connected to the exposure unit 24, a high voltage supply unit 41, the solenoid clutch 47, the motor driver 42, an AC driver circuit 43, the paper sensor 27, the paper jam sensor 34, the cover switch 50, the cartridge switch 90 and the video controller 45. The microcomputer 40 is supplied with a voltage by the low voltage power supply unit 44. The high voltage power supply unit 41 supplies power to the developing unit 23, the transfer unit 30 and the electrostatic eraser unit 31.

The motor driver 42 is provided for driving the main motor 70. As described above, the main motor 70 is connected via the first to fourth transmission gears to the automatic paper supply unit 21, the manual paper supply unit 22, the photo-sensitized drum 29, the paper discharge motor 36 and the heat roller 60A so that the microcomputer 40 is able to control these units by driving the main motor 70.

Motion of the main motor 70 is transmitted via the solenoid clutch 47 to resist rollers 26A, 26B. The microcomputer 40 drives the resist rollers 26A, 26B by connecting and disconnecting the solenoid clutch 47.

The AC driver 43 controls power supply to the heater 61 according to the signal sent from the microcomputer 40. A thermo-sensor 63 is provided near the heat roller 60A in the fixation unit 33 and transmits temperature measurement results to the microcomputer 40. The microcomputer 40 switches the heater 61 according to the signal sent from the thermo-sensor 63 to keep the temperature at the heat roller 60A in the optimal range for fixing toner images onto the printing paper.

The paper sensor 27 and the print jam sensor 34 send ON signals to the microcomputer 40 when printing paper reaches these sensors. The cover switch 50 sends a high-level signal to the microcomputer 40 when the upper cover 38 is open. The cartridge switch 90 sends a signal to the microcomputer 40 when a cartridge 80 is installed to the upper cover 38.

The video controller 45 materializes data on print characters and print commands sent from external devices 46, and microcomputer 40 controls the exposure unit 24 based on the materialized print data. The video controller 45 is connected to the LCD 85 and the buzzer 86 and controls both the LCD 85 and the buzzer 86 according to instructions given by the microcomputer 40.

The operation of the embodiment will be described hereinafter with reference to FIG. 5, in which reference character Si (i=1, 2, 3...) indicates steps. When the electro-photographic device is turned on, the microcomputer 40 executes a predetermined initialization. Then, the microcomputer 40 turns on the heater 61 for heating the heat roller 60A to a fixation temperature enabling the fixing of a toner image onto a printing paper. Further, the microcomputer 40 waits for printing data which are output from the video controller 45. The microcomputer 40 starts the printing operation when the printing data are output from the video controller 45. In the printing operation, the microcomputer 40 initiates drive of the main motor 70 and controls the main motor 70 to send printing paper from either of the paper supply units 21 and 22 to resist rollers 26A and 26B.

The microcomputer 40 keeps the resist rollers 26A and 26B still for a fixed interval after the paper sensor detects printing paper by not gearing the solenoid clutch. This procedure is for setting the printing paper in the right direction. Printing paper abuts the resist rollers and slacken, and misdirection of the printing paper is corrected. The microcomputer 40 gears the solenoid clutch to drive resist rollers 26A and 26B and sends the printing paper towards the image formation unit 25.

Meanwhile, the microcomputer 40 controls the exposure unit 24 to form an electrostatic latent image on the photo-sensitized drum 29. The latent image is developed by the developing unit 23 to form a toner image. The toner image is transferred by the transfer unit 30 onto a printing paper sent to the image formation unit 25. The printing paper carrying the toner image is sent to the fixation unit 33, and the toner image is fixed by the heat roller 60A kept at the fixation temperature. The paper discharge roller 36 sends the printing paper with the fixed toner image out to the paper discharge tray 37.

The microcomputer 40 decides that the electrophotographic device is in a paper jam state when the paper jam sensor 34 does not turn on within a fixed interval after the printing paper is sent by resist rollers 26A and 26B when the paper jam sensor 34 does not turn off within a fixed interval after the jam sensor 34 turns on. In a paper jam situation, the microcomputer 40 stops the main motor 70, aborts print execution and executes an error process to inform an operator that the electrophotographic device is in a paper jam state by beeping the buzzer 86 and/or displaying a message on the LCD 85.

Figure 5:
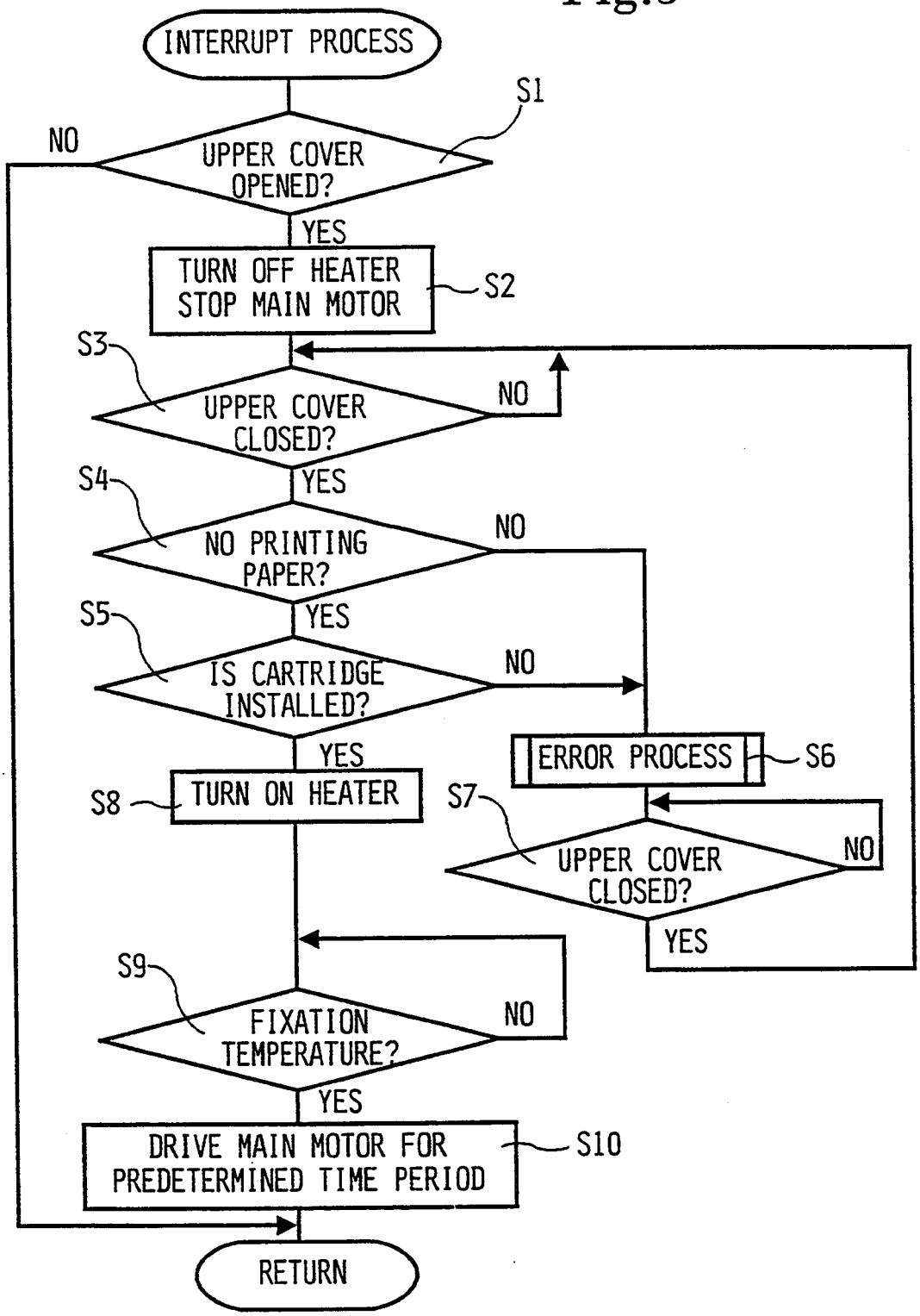
FIG. 5 is a flowchart showing the control sequence of the electro-photographic device.

The microcomputer 40 executes an interrupt process as shown in FIG. 5 when it receives a high-level signal indicating that the upper cover 38 is open. In the interrupt process, the state of the upper cover 38, i.e., whether it is open or closed, is examined according to the signal on the signal line 57 (S1). Normally, the upper cover 38 is closed and the projection 51 of the upper cover 38 urges the actuator 52 downward. Accordingly, the contact 53 connects with the terminal 54, and a low-level signal is introduced to the signal line 57 causing the microcomputer 40 to decide "NO" in S1, resulting in termination of the interrupt process and resumption of the process before interruption.

When an operator opens the upper cover 38 to exchange the cartridge 80 or to recover a paper jam, the projection 51 parts from the actuator 52. The contact 53, consisting of a leaf spring, along with the actuator 53, is urged by the force of the leaf spring and elevated. Consequently, the contact 53 parts from the terminal 54, introducing a high-level signal to the signal line, causing the microcomputer 40 to cut off power to the heater 61 and stop the main motor 70 (YES in S1). Further in S2, the microcomputer 40 instructs the video controller 45 to beep the buzzer 86 three times and/or display a warning message on the LCD to notify the operator that the upper cover 38 is open.

In the next step, the state of the upper cover 38 is examined according to the level of signal introduced on the signal line (S3). The microcomputer 40 executes S3 until it detects a low-level signal on the signal line 57.

When the upper cover 38 is closed after removal of the printing paper or cartridge exchange operation, the projection 51 urges the actuator 52 downward against the resilience of the contact 53. The contact 53 connects with the terminal 54 as the actuator 52 moves downward. As a result, a low-level signal is introduced on the signal line 57. The microcomputer 40 detects a low-level signal on the signal line 57 (YES in S3) and executes the next step S4.

In S4, the microcomputer 40 examines if there is printing paper in the paper path according to signals sent from paper sensor 27 and paper jam sensor 34. If the upper cover 38 is closed without printing paper removed in a paper jam recovery operation or with printing paper left after a cartridge exchange operation during a printing process, the microcomputer 40 detects a signal from the paper sensor 27 or the paper jam sensor 34, finds that there is paper left (NO in S4) and executes the error process (S6).

In the error process, the video controller displays a paper-left message on the LCD 85 and beeps the buzzer 86, notifying an operator that there is printing paper left in the electro-photographic device.

Meanwhile, if an operator removes the printing paper in the paper jam recovery operation or exchanges the cartridge 80 without the printing process being executed, the microcomputer finds that there is no printing paper left in the device (YES in S4) and executes S5.

In S5, if a cover open/close operation occurs after the paper jam recovery operation, the microcomputer 40 sends a signal indicative of completion of the paper jam operation and being ready to resume the printing process to the video controller 45.

In S5, the microcomputer 40 decides whether or not the cartridge 80 is installed in the upper cover 38 according to the signal sent from the cartridge switch 90. If the microcomputer 40 decides that the cartridge 80 is not installed, the microcomputer 40 instructs the video controller 45 to display a message indicative of the absence of the cartridge 80 on the LCD 85 and beep the buzzer 86, notifying the operator that the cartridge 80 is not installed to the upper cover 38.

After the execution of the error process, the microcomputer 40 examines if the upper cover 38 is opened to exchange the cartridge 80 or to remove the printing paper remaining in the device (S7). The examination is iterated until the upper cover 38 is closed (NO in S7). If the upper cover is closed (YES in S7), S3 is executed. In this way, processes from S3 to S7 are iterated until the paper remaining in the device is removed and the cartridge 80 is installed to the upper cover 38.

In S5, if the cartridge 80 is installed (YES in S5), power supply to the heater 61 is resumed and the heat roller 60A is heated, and the video controller 45 erases the message on the LCD 85. In this process, the microcomputer examines the temperature at the thermosensor 63 until the temperature reaches fixation temperature (NO in S9). After the temperature reaches the fixation temperature (YES in S9), in other words, the heat roller 60A is heated to the fixation temperature, the main motor 70 is driven for a fixed interval or a predetermined time period (S10) so that the photosensitized drum driving gear 76 and the first transmission gear 72 are synchronized.

After execution of S10, the microcomputer 40 terminates the interrupt process and resumes operation before the interruption.

As described above in the electro-photographic device of the present embodiment, if printing paper remains in the electro-photographic device, the microcomputer 40 notifies the operator. Otherwise, if the microcomputer 40 detects no paper left in the device, the main motor 70 is driven for a fixed interval to synchronize the photo-sensitized drum driving gear 76 with the first transmission gear. With this control scheme, the electro-photographic device avoids damage to the photo-sensitized drum by preventing toner from adhering to the cold heat roller 60A.

If the main motor is driven for a fixed interval even when printing paper is not found in the device, the silicon film incurs possible damage by left over toner on the contact roller 62 adhering to the cold heat roller 60A. However, the electro-photographic device of the present embodiment avoids such damage by heating the heat roller 60A to the fixation temperature before driving the main motor 70. In this scheme, the heat roller 60A is heated hot enough to melt the toner, effectively avoiding the damage to the photosensitized drum.

While advantageous embodiments have been chosen to illustrate the invention, it will be understood by those skilled in the art that various changes and modifications can be made therein without departing from the scope of the invention as defined in the appended claims.

What is claimed is:

1. An electro-photographic device for forming an image on a substrate and having a main body and a cover mounted thereto for movement between an open position and a closed position, comprising:

paper supply means for supplying a substrate;

paper feeding means for feeding the substrate supplied from said paper supply means in a paper path;

paper detecting means located in said paper path for detecting presence of the substrate in said paper path;

image forming means located in said paper path for forming an image on the substrate;

image fixing means located in said paper path for fixing the image formed by said image forming means on the substrate, including heating means for heating the image and heating determining means for determining when said heating means is heated to within a predetermined fixing temperature range;

driving means coupled to said paper feeding means or driving said paper feeding means and coupled to said image forming means when said cover is in the closed position; and control means coupled to said driving means, said paper detecting means and said image fixing means for delaying said driving means from driving and including synchronizing means for driving said driving means during a predetermined period after closing of said cover to synchronize and engage said driving means with said image forming means after said heating means has reached the fixing temperature range and said paper detecting means detects no substrate in said paper path.

2. The electro-photographic device of claim 1, wherein said driving means is disposed in said main body, and said image forming means includes a photo-sensitized drum disposed in said cover, wherein said photo-sensitized drum is disengaged with said driving means when said cover is in said open position and is engaged for synchronization with said driving means when said cover is in said closed position.

3. The electro-photographic device of claim 2, wherein said photo-sensitized drum has a first driving gear, and wherein said driving means comprises a drive shaft and a second driving gear, and wherein said first gear and said second gear engage to transmit driving force to said photo-sensitized drum when said cover is in the closed position and disengage when said cover is in the open position.

4. The electro-photographic device of claim 3, wherein said photo-sensitized drum and said first gear are disposed in a removable cartridge in said cover, and said cover has a cartridge sensor therein for detecting installation of said cartridge.

5. The electro-photographic device of claim 3, wherein said synchronizing means includes a timer for timing a period for driving said driving means to synchronize said first and second gears after moving said cover from the open position to the closed position.

6. The electro-photographic device of claim 1, wherein said paper supply means includes an automatic paper supply and a manual paper supply.

7. The electro-photographic device of claim 1, wherein said paper detecting means comprises a paper sensor located in said paper path upstream of said image forming means and a paper jam sensor located downstream of said image forming means.

8. The electro-photographic device of claim 1, wherein said image fixing means further comprises a roller with a non-stick coating thereon coupled to said heating means for heating said roller.

9. The electro-photographic device of claim 1, wherein said image fixing means further comprises a roller having a silicon coating and wherein said heating means is a heater coupled to said roller.

10. The electro-photographic device of claim 1, further comprising cover position detecting means for detecting the open and closed position of said cover, said cover position detecting means being coupled to said control means for providing a signal to said control means to control said driving means based on the position of said cover.

11. The electro-photographic device of claim 10, wherein said cover position detecting means is a switch comprising a terminal connected to ground and an actuator connected to a voltage supply, said actuator being coupled to said control means by a signal line having a resistor.

12. The electro-photographic device of claim 11, wherein said actuator is a leaf spring.

13. The electro-photographic device of claim 10, wherein said cover has an upper portion and a lower portion pivotally connected thereto and said cover position detecting means comprises a projection on said upper portion and a spring biased actuator on said lower portion aligned with said projection, said actuator being electrically connected to ground when said projection contacts said actuator.

14. An electro-photographic device comprising:

a cover movably coupled to a main body between an open and closed position;

a cover detector detecting whether said cover is opened or closed;

a paper feeder feeding a printing paper through said device in a paper sending path;

a driver coupled to said paper feeder and driving said paper feeder;

a paper detector detecting printing paper in said paper sending path;

an image forming unit located in said paper sending path for forming an image on the printing paper, wherein said image forming unit includes a photo-sensitized drum disposed in said cover, said photo-sensitized drum being disengaged with said driver when said cover is in said open position and being engaged with said driver when said cover is in said closed position after a period of synchronization;

an image fixation unit for fixing the image on the paper, said image fixation unit including a temperature measurer measuring temperature in said fixation unit; and a controller controlling said driver to drive during a predetermined period and to synchronize with said photo-sensitized drum after said cover is closed when said paper detector detects no printing paper in said paper sending path and selectively prohibiting said driver from driving when said paper detector detects printing paper left in said paper sending path, wherein said controller further prohibits said driver from driving when a temperature measured by said measurer is not within a predetermined optimal temperature range.

15. The electro-photographic device of claim 14, wherein said paper detector comprises two independent detecting devices spaced from each other in said paper sending path for determining whether printing paper is trapped in said paper sending path.

16. The electro-photographic device of claim 14, further comprising a display displaying messages indicating that a printing paper is left in said paper sending path to an operator.

17. The electro-photographic device of claim 14, further comprising:

a power controller controlling power supply to said fixation unit to maintain temperature of said fixation unit within the predetermined optimal temperature range.

18. The electro-photographic device of claim 17, wherein said power controller includes a shut-off that stops power supply to said fixation unit while said cover is open.

* * * * *